United States Patent [19]

Grunert

[11] 4,314,734

[45] Feb. 9, 1982

[54] CABINET DRAWER SUPPORT

[75] Inventor: Hans C. Grunert, Adelberg, Fed. Rep. of Germany

[73] Assignee: Sybron Corporation, Rochester, N.Y.

[21] Appl. No.: 147,362

[22] Filed: May 7, 1980

[51] Int. Cl.[3] ..... A47B 88/18; A47F 5/12

[52] U.S. Cl. ..... 312/322; 312/323; 312/333; 108/8

[58] Field of Search ..... 312/322, 323, 313, 320, 312/311, 333; 108/1, 3, 8, 6, 33

[56] References Cited

U.S. PATENT DOCUMENTS

| | | | |
|---|---|---|---|
| 321,078 | 6/1885 | Birckhead | 312/323 |
| 776,736 | 12/1904 | Greenen | 312/323 |
| 1,360,086 | 11/1920 | Braekke et al. | 312/311 |
| 1,594,291 | 7/1926 | Woltz | 312/323 |
| 3,179,480 | 4/1965 | Brinker | 312/320 |
| 3,716,282 | 2/1973 | Propst et al. | 312/322 |
| 3,988,802 | 11/1976 | Bruni et al. | 312/320 |
| 4,172,624 | 10/1979 | Swain | 312/333 |

FOREIGN PATENT DOCUMENTS

| | | | |
|---|---|---|---|
| 112331 | 1/1941 | Australia | 312/323 |
| 130178 | 11/1948 | Australia | 312/323 |
| 626762 | 9/1978 | U.S.S.R. | 312/322 |

*Primary Examiner*—Victor N. Sakran

*Attorney, Agent, or Firm*—Theodore B. Roessel; Roger Aceto

[57] ABSTRACT

Cabinet drawers are supported by members projecting from the sides of the drawers into slots defined by guide rails at the sides of the cabinet. Notches in the guide rails permit the drawers to pivot into an inclined position when the drawers are opened. This makes objects within the drawers more visible and accessible.

6 Claims, 4 Drawing Figures

CABINET DRAWER SUPPORT

BACKGROUND OF THE INVENTION

This invention relates to a system for supporting drawers in a cabinet so that the drawers can pivot into an inclined position when they are opened. This makes objects within the drawers more visible and accessible, and permits the use of higher storage cabinets in certain instances.

Many storage cabinets for tools, small appliances, parts and the like are used in circumstances where someone should be able to reach items within the drawers with a minimum of movement. For example, in modern dentistry the dentist and his assistant are usually seated beside the patient. They may need any of a large variety of small tools, materials and the like during a typical dental procedure, and it is desirable to store many of these tools and materials so that they are visible and accessible to the dentist and/or his assistant in their normal seated positions beside the patient.

Presently available cabinetry typically provides a number of shallow drawers located at waist level or below. Tools and materials within these drawers are accessible, but keeping the drawers at or below waist level limits the available storage space. It would be desirable to place some of these drawers at a higher elevation without reducing the visibility and/or accessibility of items within the drawers. This can be accomplished by supporting the drawers so that they can pivot into an inclined position when they are opened.

SUMMARY OF THE INVENTION

In this invention the cabinet drawers are supported by upper and lower guide rails which define slots at each side of the cabinet, and by support members projecting from the sides of the drawers into the slots. Preferably all of the upper and lower guide rails are molded as a single insert that can be slid into the shell of the cabinet. This reduces the expense of the support system.

There is a notch in each lower guide rail near the front of the slot, and a second notch in each upper guide rail behind the first notch. The front support members are wider than the notches in the lower guide rails. Thus, the front support members bridge these notches and hold the drawers in the horizontal position when the drawers are slid into the cabinet. Preferably, a section of each lower guide rail, in front of the notch, is higher than the portion of the guide rail that extends behind the notch. Consequently, the front support member rests behind the raised front portion of the guide rail when the drawer is closed, which prevents accidental opening of the drawer.

An intermediate support member and a rear support member also project from each side of each drawer. The intermediate member is adapted to drop into the notch in the lower guide rail when the drawer is pulled forward into the open position. At the same time, the rear support member pivots upwardly into the notch in the upper guide rail. As a result, the drawer pivots to an inclined position, and is supported in this position, making objects within the drawer readily visible and accessible to someone in front of the cabinet.

DRAWINGS

DETAILED DESCRIPTION

The illustrated cabinet includes an upper cabinet 10, embodying this invention, which can be set on various other cabinets 12 or the like in modular fashion. This helps the dentist and the dental equipment supplier assemble equipment that fits the particular needs and preferences of the individual dentist.

Figure 3:
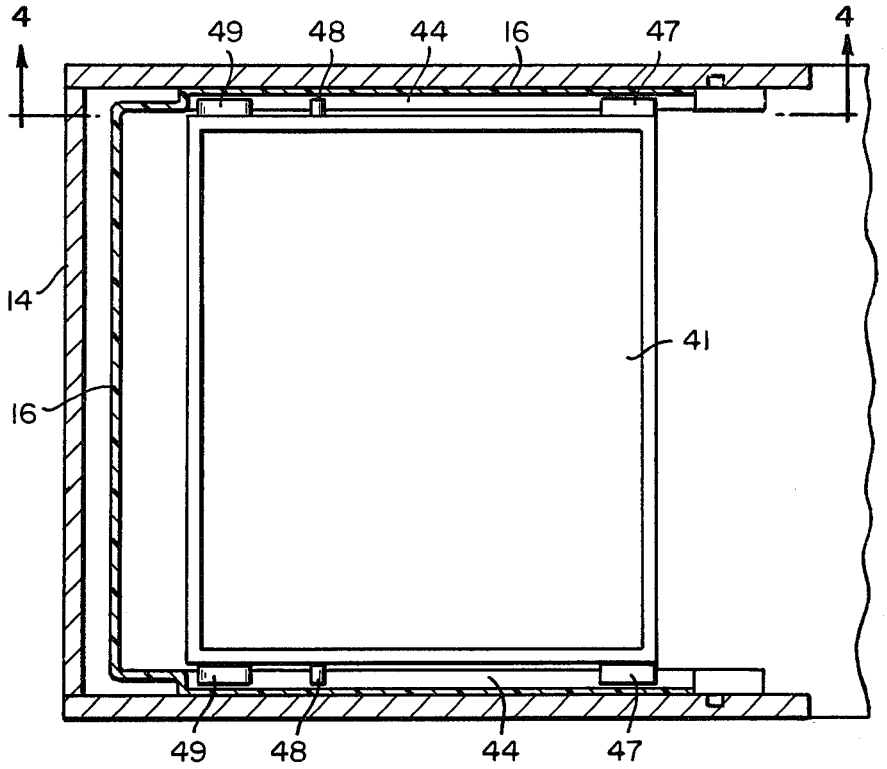
FIG. 3 is a cross-sectional plan view taken along lines 3—3 in FIG. 2.

Upper cabinet 10 has an outer shell 14 containing an insert 16 that supports the drawers 21, 31, 41 within the cabinet. As is best shown in FIG. 3, the insert 16 is preferably molded in one piece and dimensioned to slide into and fit snugly within the outer shell 14 of the cabinet. This helps reduce the cost of manufacturing and installing the insert.

Slots 22, 32, 42 are molded into each side of the insert. The upper edges of the slot serve as upper guide rails 23, 33, 43. The lower edges of the slots serve as lower guide rails 24, 34, 44. Each lower guide rail contains a notch 26, 36, 46 near the front of the slot, and each upper guide rail 23, 33, 43 contains a notch positioned behind the corresponding notch in the lower guide rail, i.e., towards the rear of the cabinet. These guide rails and notches support the drawers in the cabinet and control the movement of the drawers as they are opened and closed.

Support members project from the sides of the drawers into these support slots. There is a front support member 27, 37, 47, an intermediate support member 28, 38, 48, and a rear support member 29, 39 and 49 on each side of each drawer.

The front support members 27, 37, 47 are wider than the notches 26, 36, 46 in the lower guide rails. This insures that the front of the drawer is supported positively when the drawer is closed.

Figure 4:
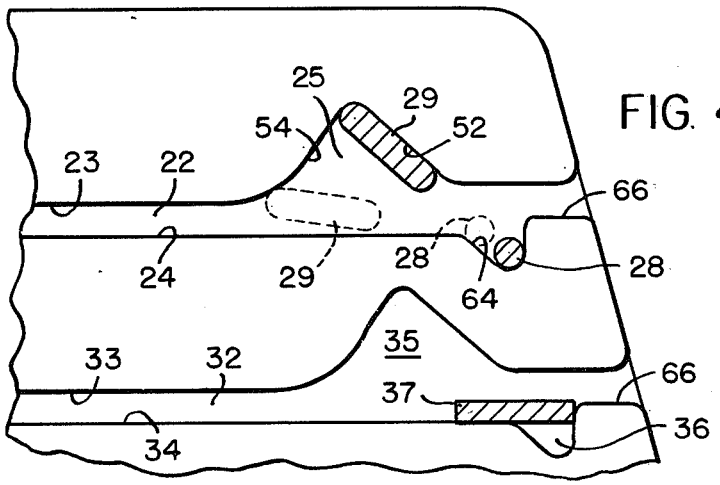
FIG. 4 is a cross-sectional detail view, from the same vantage point as FIG. 2, taken along lines 4—4 in FIG. 3.

As is perhaps best shown in FIG. 4, the front sections 66 of the lower guide rails 24, 34, 44, in front of notches 26, 36, 46, are higher than the sections of the guide rail extending behind the notches. Thus, the front support members 27, 37, 47 rest behind these front edges 66 when the drawer is closed, which helps prevent accidental opening of the drawers.

Figure 1:
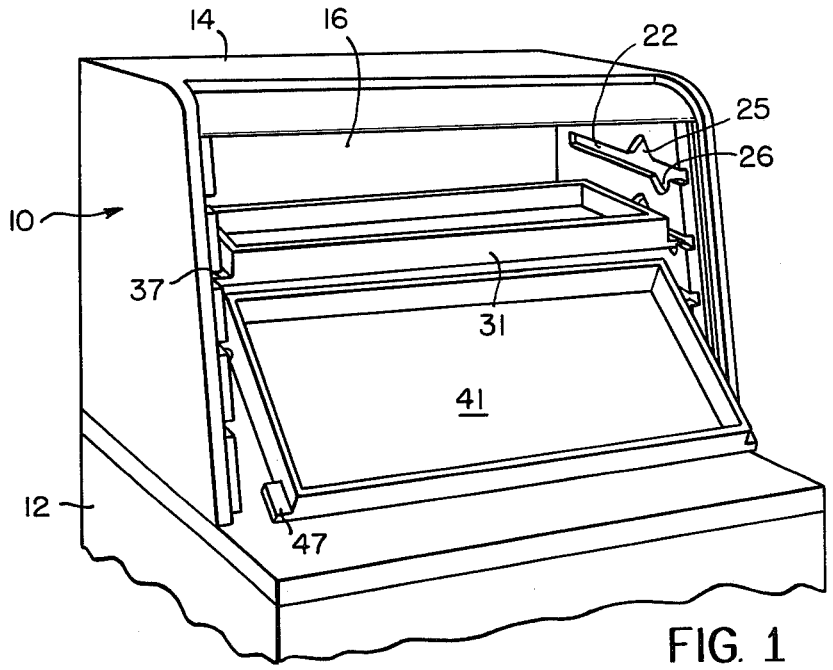
FIG. 1 is a perspective view of a dental cabinet embodying this invention.
Figure 2:
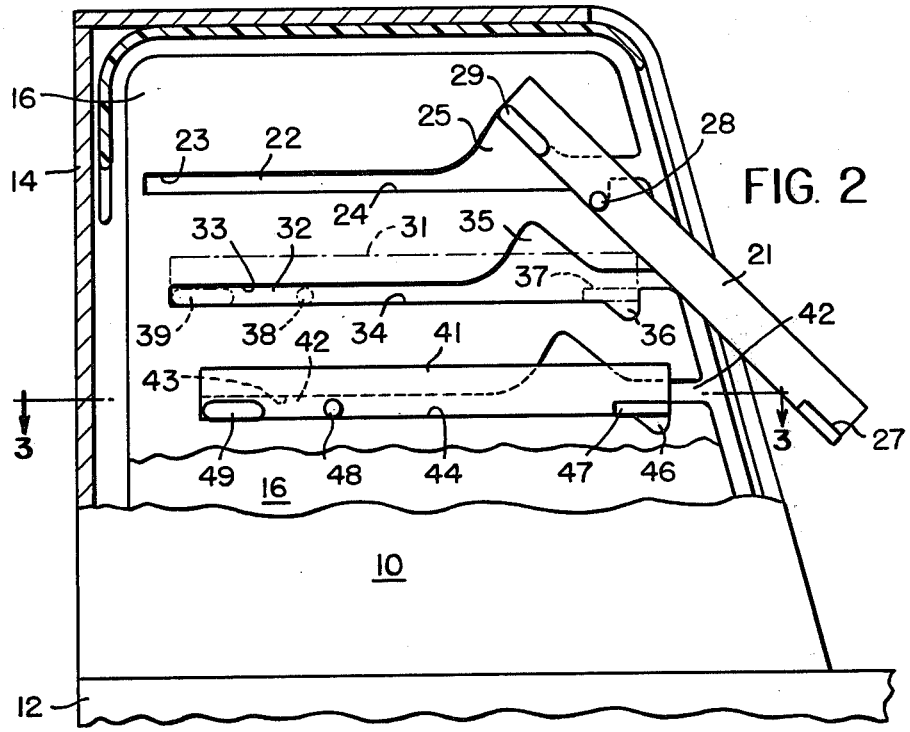
FIG. 2 is a left side elevation view of the cabinet in FIG. 1, with the left side of the cabinet and the left guide rails removed to show the position of the drawers within the cabinet and their relation to the guide rails on the far right side of the cabinet.

As may be seen by referring to FIG. 4 and to the top drawer 21 in FIG. 2, the intermediate support members 28, 38 and 48 and the rear support members 29, 39 and 49 control the movement of the drawers as they are opened. In keeping with the invention, they also support the drawer when it is closed.

Unlike the front support members, the intermediate support members 28, 38, 48 are narrower than the notches 26, 36 and 46 in the lower guide rails. Thus, the intermediate support members can drop into these notches when a drawer is opened. Preferably, the rear edge 64 of each lower notch 26, 36, 46 is inclined to allow the intermediate support members 28, 38, 48 to drop smoothly into the notches, and the front edge 62 of each notch is vertical so that these edges act as positive stops that keep the intermediate support members from riding over the front edges 66 of the lower guide rails.

The intermediate support members 28, 38, 48 are positioned behind the mid-points of the drawers. Thus, the weight of the drawers and their contents tend to pivot the front ends of the drawers downwardly about the intermediate support members, and to pivot the rear support members 29, 39, 49 up into the notches 25, 35, 45 in the upper guide rails. The illustrated intermediate support members 28, 38, 48 are cylindrical, which allows the drawers to pivot smoothly about the intermediate supports as they enter the notches 26, 36, 46. Other curved surfaces would serve the same purpose. However, the cylindrical shape is preferred for simplicity.

As may be seen in FIG. 4, the back edge of each notch 25, 35, 45 in the upper guide rails function as a guide ramp 54 that controls the pivotal movement of the rear support member 29 as the intermediate support member 28 enters the notch 26 in the lower guide rail. The preferred guide ramp is a convex curve that leads smoothly from the horizontal portion of the upper guide rail 23 into notch 25.

The distance from the front of the intermediate support members 28, 38, 48 to the back of the rear support members is approximately the same as the distance from the bottoms of the lower notches 26, 36, 46 to the tops of the upper notches 25, 35, 45. Thus, when the intermediate support members reach the bottom of the lower notches, the rear support members can pivot to the top of the upper notches. The rear support members are elongated to provide a flat upper surface, and the front edges 52 of notches 25, 35 and 45 have a complementary flat surface. The front edges 52 are inclined at the angle assumed by the rear support members 29, 39 and 49 in the open position. Thus, the rear support members bear against fairly large surfaces, which distributes any shock that occurs if the rear support members pivot rapidly into the notches.

With intermediate support member 28 and rear support member 29 at the apices of notch 26 and notch 25 respectively, drawer 21 is firmly supported in the inclined position. With the drawer in this position, a dentist or dental assistant seated in front of the cabinet can easily see and reach objects in the drawer. Typically, the drawer may be inclined at an angle of approximately 40 degrees. This provides adequate accessibility without disturbing objects in the drawer too much. This angle may be easily increased or decreased by the cabinet designers for particular applications.

As may be seen from the foregoing description, the illustrated support systems provides a simple and effective mechanism for allowing the cabinet drawers to pivot to the inclined position. The drawers are supported firmly and positively during both storage and use, and the support system is relatively easy to manufacture and economical. Thus, this invention, which is defined by the following claims, makes it easier to see and use articles located in the drawers, and allows increased storage space to be built into a wide variety of cabinets.

I claim:

1. In a system for supporting one or more drawers within a cabinet including upper and lower guide rails fixed within the cabinet to define a guide slot at each side of the cabinet, and support members projecting from the drawers and into the slots, the improvement comprising:

(a) said lower guide rail having a first notch formed therein adjacent the front of said slot, the front edge of said notch being vertical and a section of said lower guide rail in front of said front edge being higher than the section of said lower guide rail to the rear of said notch;

(b) said upper guide rail having a second notch therein spaced rearward of said first notch;

(c) a front support member projecting laterally from said drawer and into said slot at a position located just behind said higher section of guide rail when said drawer is closed, said front support being wider than said first notch so as to rest on said lower guide rail when said drawer is closed;

(d) an intermediate support member projecting laterally from said drawer and into said slot at a position behind the midpoint of said drawer, said intermediate support member being narrower than said first notch and adapted to drop into said first notch when said drawer is pulled outward from said cabinet to an open position;

(e) a rear support member projecting laterally from said drawer and into said slot adjacent the rear of said drawer, said rear support member being positioned with respect to said intermediate support member so as to pivot upwardly into said second notch when said intermediate support member drops into said first notch whereby the portion of said drawer pulled from said cabinet pivots downwardly about said intermediate support member to an inclined position; and (f) the rear edge of said upper notch defining a guide ramp for controlling the pivotal movement of said rear support member about said intermediate support member and into said upper notch.

2. A support system according to claim 1 wherein the rear edge of said first notch is inclined to allow said intermediate support member to drop smoothly into said first notch.

3. A support system according to claim 1 wherein said intermediate support member is cylindrical.

4. A support system according to claim 1 wherein said guide ramp comprises a convex surface leading into said second notch.

5. A support system according to claim 1 wherein said rear support member has a flat upper surface, and said second notch has a flat front edge inclined at the angle assumed by said rear support member when said intermediate support member is at the bottom of said first notch and said rear support member has reached the limit of its pivotal movement into said second notch.

6. A support system according to claim 1 or 5 wherein the distance from the front of said intermediate support member to the back of said rear support member is approximately the same as the distance from the bottom of said first notch to the top of said second notch, whereby said support members seat firmly in said notches and said drawer is firmly supported in the open position.

* * * * *